US011440757B2

(12) United States Patent
Yasuda et al.

(10) Patent No.: US 11,440,757 B2
(45) Date of Patent: Sep. 13, 2022

(54) SHEET FEEDING APPARATUS, PRINTING APPARATUS, AND SHEET FEEDING METHOD

(71) Applicant: CANON KABUSHIKI KAISHA, Tokyo (JP)

(72) Inventors: Yuya Yasuda, Kawasaki (JP); Masahiro Kawanishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/938,194

(22) Filed: Jul. 24, 2020

(65) Prior Publication Data

US 2021/0039903 A1 Feb. 11, 2021

(30) Foreign Application Priority Data

Aug. 9, 2019 (JP) ..... JP2019-147518

(51) Int. Cl.

| | |
|---|---|
| ***B65H 3/06*** | (2006.01) |
| ***B65H 5/06*** | (2006.01) |
| ***B65H 29/20*** | (2006.01) |
| ***B65H 3/34*** | (2006.01) |

(52) U.S. Cl.

CPC ..... *B65H 3/0684* (2013.01); *B65H 3/34* (2013.01); *B65H 5/066* (2013.01); *B65H 5/068* (2013.01); *B65H 29/20* (2013.01); *B65H 2403/481* (2013.01)

(58) Field of Classification Search

CPC ..... B65H 3/06; B65H 3/0661; B65H 3/0684; B65H 3/34; B65H 2403/481

See application file for complete search history.

(56) References Cited

U.S. PATENT DOCUMENTS

| | | | | |
|---|---|---|---|---|
| 8,764,005 | B2 | 7/2014 | Tajima | |
| 10,160,612 | B2 | 12/2018 | Kawanishi et al. | |
| 10,214,032 | B2 | 2/2019 | Matsuura et al. | |
| 2003/0090053 | A1* | 5/2003 | Hsiao | B65H 3/0684 271/118 |
| 2010/0308528 | A1* | 12/2010 | Chung | B65H 3/565 271/117 |
| 2015/0166275 | A1* | 6/2015 | Sato | B65H 3/0669 271/167 |
| 2017/0008712 | A1* | 1/2017 | Tateishi | B65H 3/56 |

FOREIGN PATENT DOCUMENTS

JP 2013-230904 A 11/2013

* cited by examiner

*Primary Examiner* — Prasad V Gokhale

(74) *Attorney, Agent, or Firm* — Venable LLP

(57) ABSTRACT

In order to downsize an overall apparatus without setting the swing angle of a swing member to be unnecessarily large, a pickup roller, which is for feeding a document disposed on a feeding tray, is supported by a pickup arm that is swingable about a rotation shaft. Depending on the rotational direction of the rotation axis, the pickup arm swings between a first position, in which the pickup roller is in contact with the document on the feeding tray, and a second position, in which the pickup roller is above and not in contact with the feeding tray. An arm member is rotated by rotation of the rotation axis after the pickup arm swings to the second position.

13 Claims, 15 Drawing Sheets

SHEET FEEDING APPARATUS, PRINTING APPARATUS, AND SHEET FEEDING METHOD

BACKGROUND OF THE INVENTION

Field of the Invention

The present invention relates to a sheet feeding apparatus and a sheet feeding method for feeding a sheet disposed on a sheet disposing unit and to a printing apparatus and an image reading apparatus including the sheet feeding apparatus.

Description of the Related Art

Normally, in this type of sheet feeding apparatus, a feeding roller is moved to a stand-by position in which the feeding roller is not in contact with a sheet when a sheet is not being fed, so as to improve the workability of disposing a sheet onto a sheet disposing unit and prevent deformation of the feeding roller and the sheet.

Japanese Patent Laid-Open No. 2013-230904 discloses a technology in which a swing member, which is swingable in the vertical direction, includes a feeding roller, and the swing member is made to swing upward until the swing member abuts on a regulating portion at a predetermined position, so as to move the feeding roller to a stand-by position. After the swing member abuts on the regulating portion, when the swing member swings downward because of its own weight, an engagement gear included in the swing member meshes with a rack at a predetermined position, so that the downward swing of the swing member is suppressed.

However, in the technology disclosed in Japanese Patent Laid-Open No. 2013-230904, the swing angle of the swing member must be set to be large in consideration of the downward swing of the swing member because of its own weight, which may cause increase in the size of the entire apparatus.

SUMMARY OF THE INVENTION

The present invention provides a technology for avoiding an increase in the size of a sheet feeding apparatus that feeds a sheet.

In the first aspect of the present invention, there is provided a sheet feeding apparatus including:

a sheet disposing unit on which a sheet is disposed;

a feeding roller configured to feed the sheet disposed on the sheet disposing unit;

a first swing member configured to support the feeding roller and be swingable between a first position, in which the feeding roller is in contact with the sheet disposed on the sheet disposing unit, and a second position, in which the feeding roller is more distanced from the sheet disposing unit, compared to the first position;

a rotation shaft configured to rotate in a first direction for swinging the first swing member from the second position to the first position and rotate in a second direction that is opposite to the first direction; and a second swing member configured to swing in the first direction in accordance with rotation of the rotation shaft in the second direction after the first swing member swings to the second position.

In the second aspect of the present invention, there is provided a printing apparatus including:

a sheet disposing unit on which a sheet is disposed;

a feeding roller configured to feed the sheet disposed on the sheet disposing unit;

a printing unit configured to print an image on the sheet fed by the sheet feeding apparatus;

a first swing member configured to support the feeding roller and be swingable between a first position, in which the feeding roller is in contact with the sheet disposed on the sheet disposing unit, and a second position, in which the feeding roller is more distanced from the sheet disposing unit, compared to the first position;

a rotation shaft configured to rotate in a first direction for swinging the first swing member from the second position to the first position and rotate in a second direction that is opposite to the first direction, and a second swing member configured to swing in the first direction in accordance with rotation of the rotation shaft in the second direction after the first swing member swings to the second position.

In the third aspect of the present invention, there is provided a sheet feeding method for feeding a sheet, which is disposed on a sheet disposing unit, by use of a feeding roller that is supported by a first swing member, which is swingable about a rotation shaft, the sheet feeding method including:

a step of swinging the first swing member between a first position, in which the feeding roller is in contact with the sheet disposed on the sheet disposing unit, and a second position, in which the feeding roller is more distanced from the sheet disposing unit, compared to the first position, that is, a step for swinging the first swing member from the second position to the first position in accordance with rotation of the rotation shaft in a first direction and swinging the first swing member from the first position to the second position in accordance with rotation of the rotation shaft in a second direction that is opposite to the first direction; and a step of swinging the second swing member in the first direction in accordance with rotation of the rotation shaft in the second direction after the first swing member swings to the second position.

According to the present invention, it is possible to avoid an increase in the size of a sheet feeding apparatus that feeds a sheet.

Further features of the present invention will become apparent from the following description of exemplary embodiments with reference to the attached drawings.

DESCRIPTION OF THE EMBODIMENTS

Hereinafter, an explanation is given of an embodiment of the present invention with reference to the drawings. The sheet feeding apparatus according to the present embodiment is included in the image reading/printing apparatus 1.

Figure 1A:
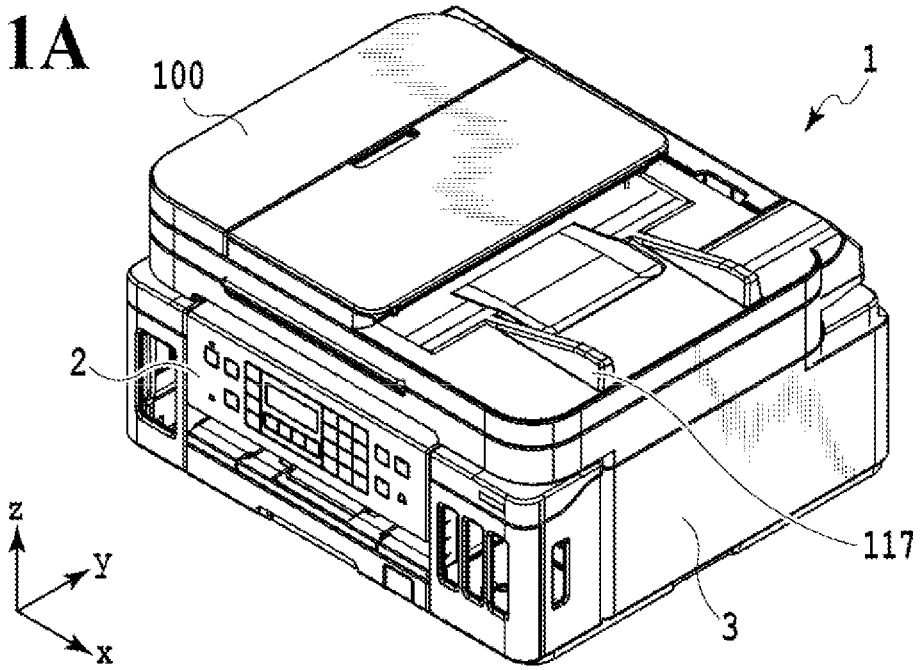
FIGS. 1A and 1B are perspective views of an image reading/printing apparatus 1 according to an embodiment of the present invention.
Figure 1B:
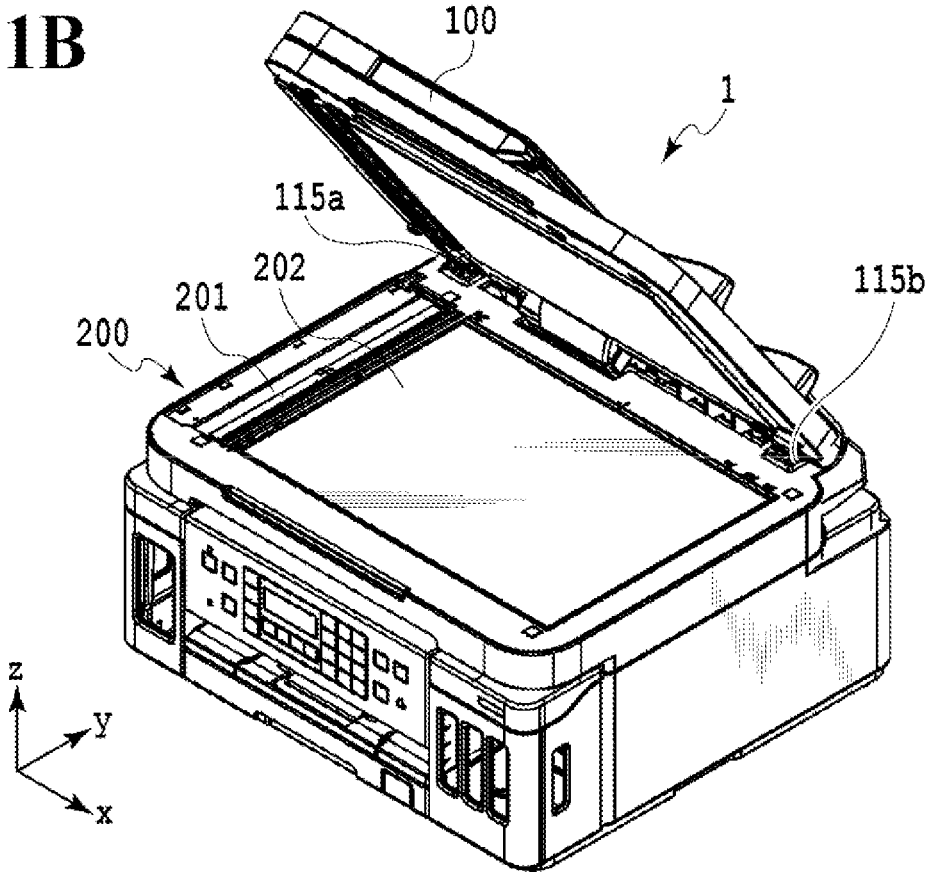
Figure 2:
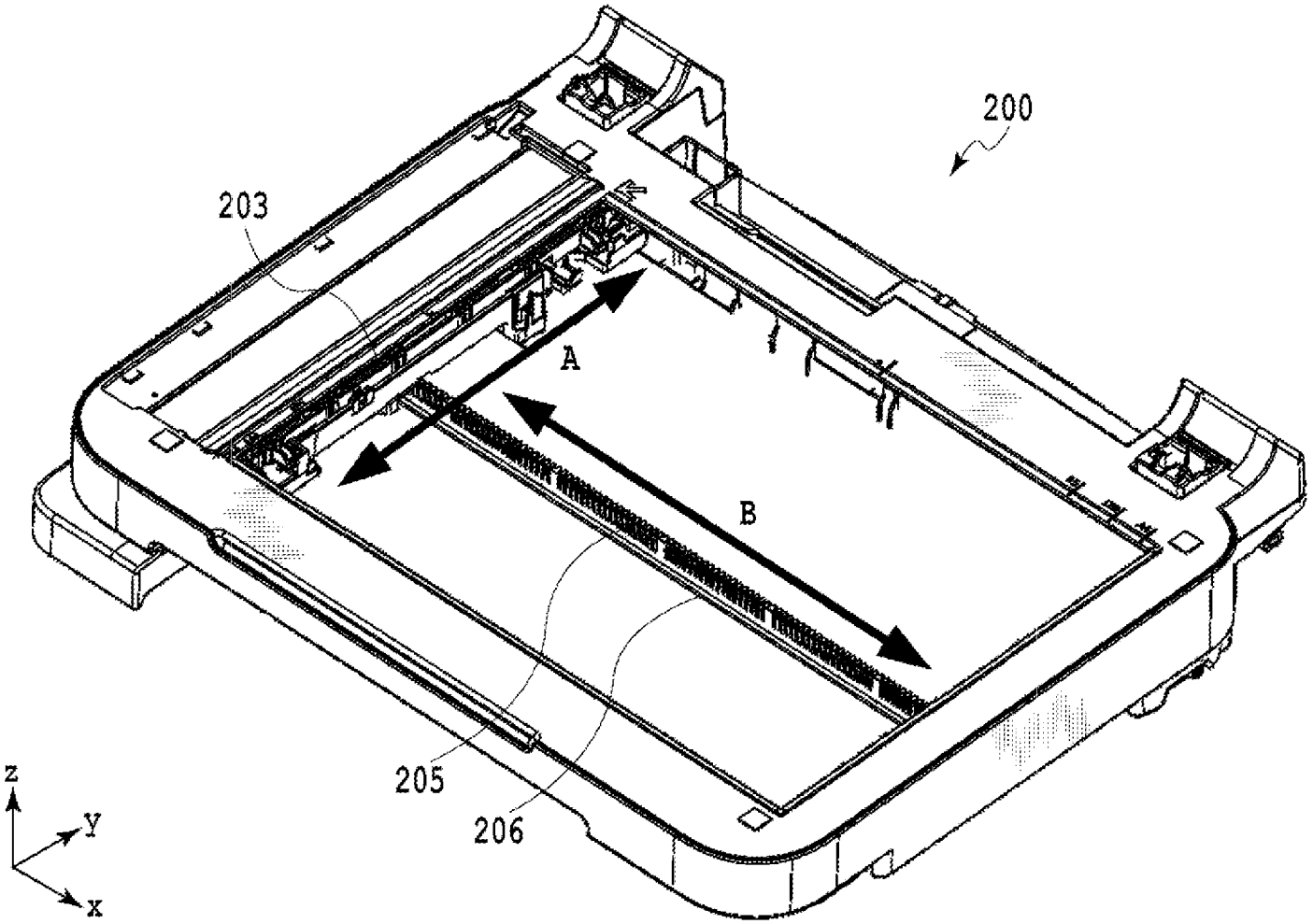
FIG. 2 is a perspective view of a flat-bed type document reading apparatus in the image reading/printing apparatus of FIGS. 1A and 1B.

FIGS. 1A and 1B are perspective views of the entire image reading/printing apparatus 1 according to the present embodiment. FIG. 2 is a perspective view of a flat-bed type image reading apparatus 200 in the image reading/printing apparatus 1. The image reading/printing apparatus 1 according to the present example integrally includes the image reading apparatus 200, a feeding mechanism 100 for feeding a document, which is a sheet intended to be fed, and an inkjet printing apparatus 3. As illustrated in FIG. 1B, the feeding mechanism 100 is mounted on the top part of the image reading apparatus 200 via the left and right hinges 115*a* and 115*b*, so as to be openable. Additionally, in the drawings, X, Y and Z respectively indicate directions orthogonal to each other. X corresponds to the width direction of the image reading/printing apparatus 1, Y corresponds to the depth direction thereof, and Z corresponds to the height direction thereof. The printing apparatus 3 is not limited to an inkjet printing apparatus and may be a printing apparatus of another format.

Figure 15:
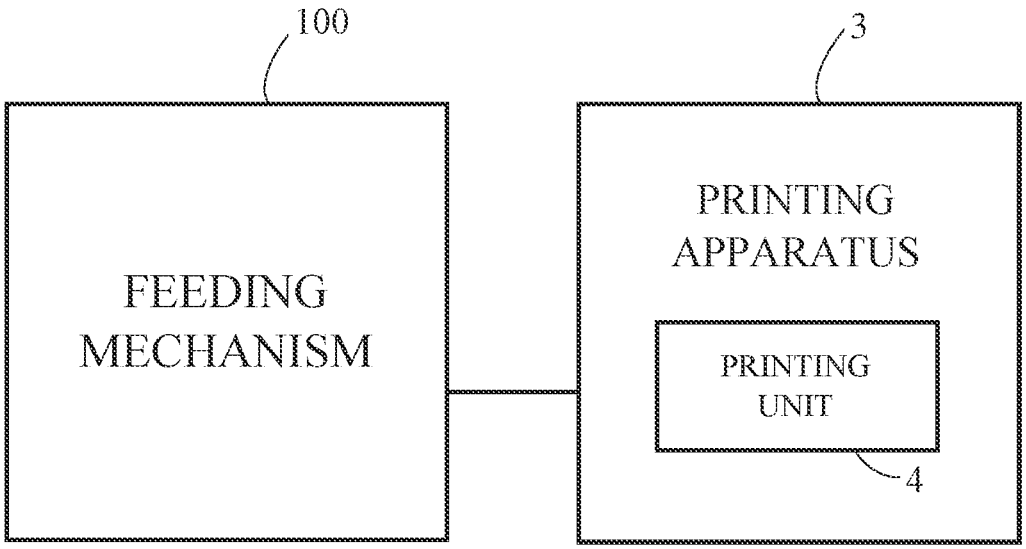
FIG. 15 is a schematic view of an embodiment in which the feeding mechanism is associated with a printing apparatus.

The printing apparatus 3 forms an image on a fed sheet by use of an image forming unit (printing unit) 4, which is not illustrated in the drawings of the first-described embodiment of the image reading/printing apparatus 1, but is schematically shown in an alternative embodiment of a printing apparatus in FIG. 15. The image reading/printing apparatus 1 is capable of copying an image read by the image reading apparatus 200 onto a sheet by use of the image forming unit. The reading unit 203 of the image reading apparatus 200 includes a line sensor capable of reading the width of the document in the transverse direction or the longitudinal direction. The reading unit 203 performs scanning in the direction (Arrow B direction) orthogonal to the direction of the line sensor (Arrow A direction), so that the image of a document on the flat-bed transparent member 202 can be read. It is assumed that the direction of the line sensor is the main scanning direction, and the direction in which the reading unit 203 moves is the sub scanning direction. The reading unit 203 employs a same-magnification optical system and is referred to as a contact image sensor (CIS). By transmitting driving force to the rack 205 from a drive unit equipped with a driver, which is not illustrated in the drawings, the reading unit 203 moves in the sub scanning direction along the guide rail 206.

Figure 3:
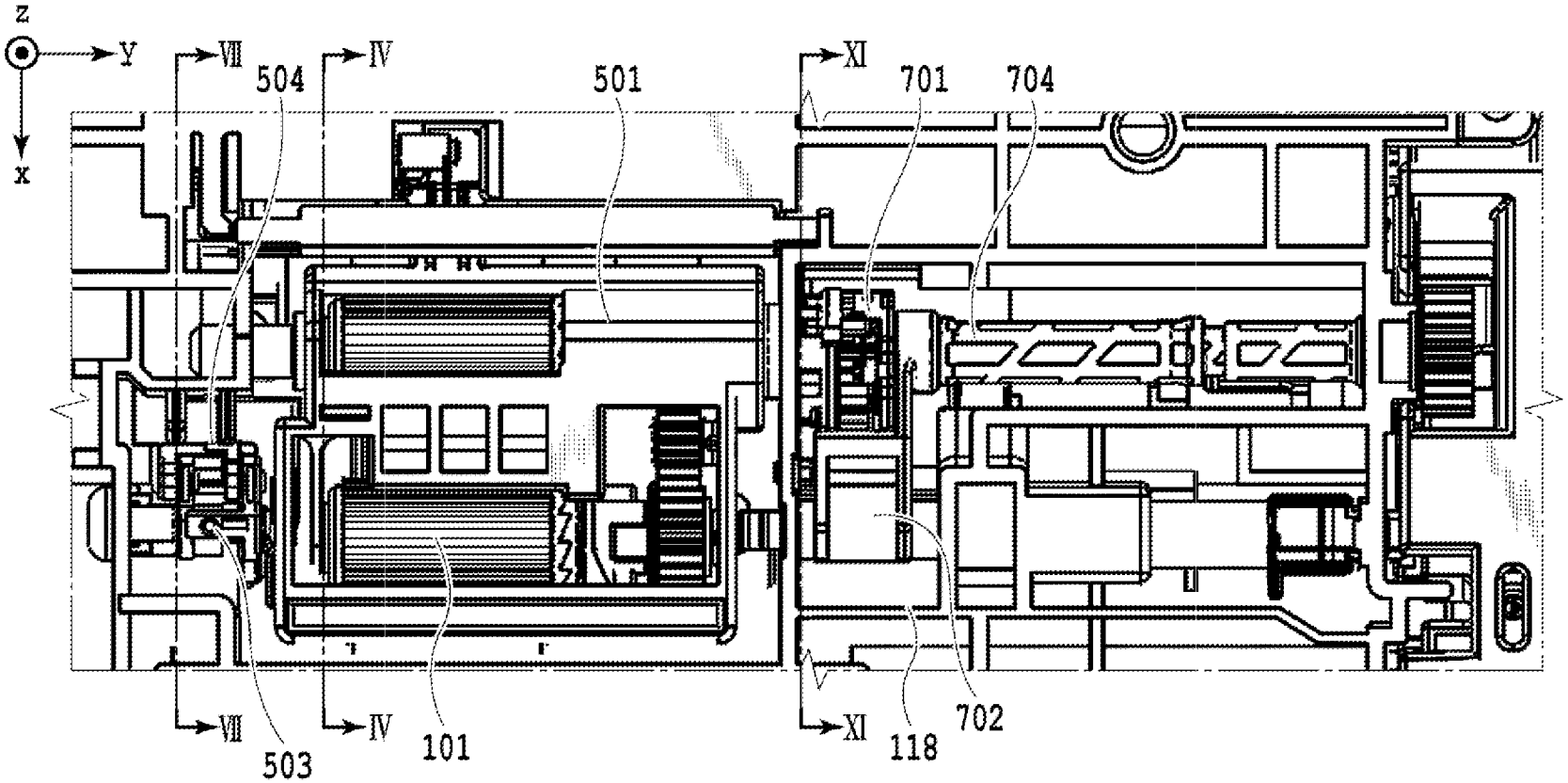
FIG. 3 is a top view of a feeding mechanism in the image reading/printing apparatus of FIGS. 1A and 1B.
Figure 4:
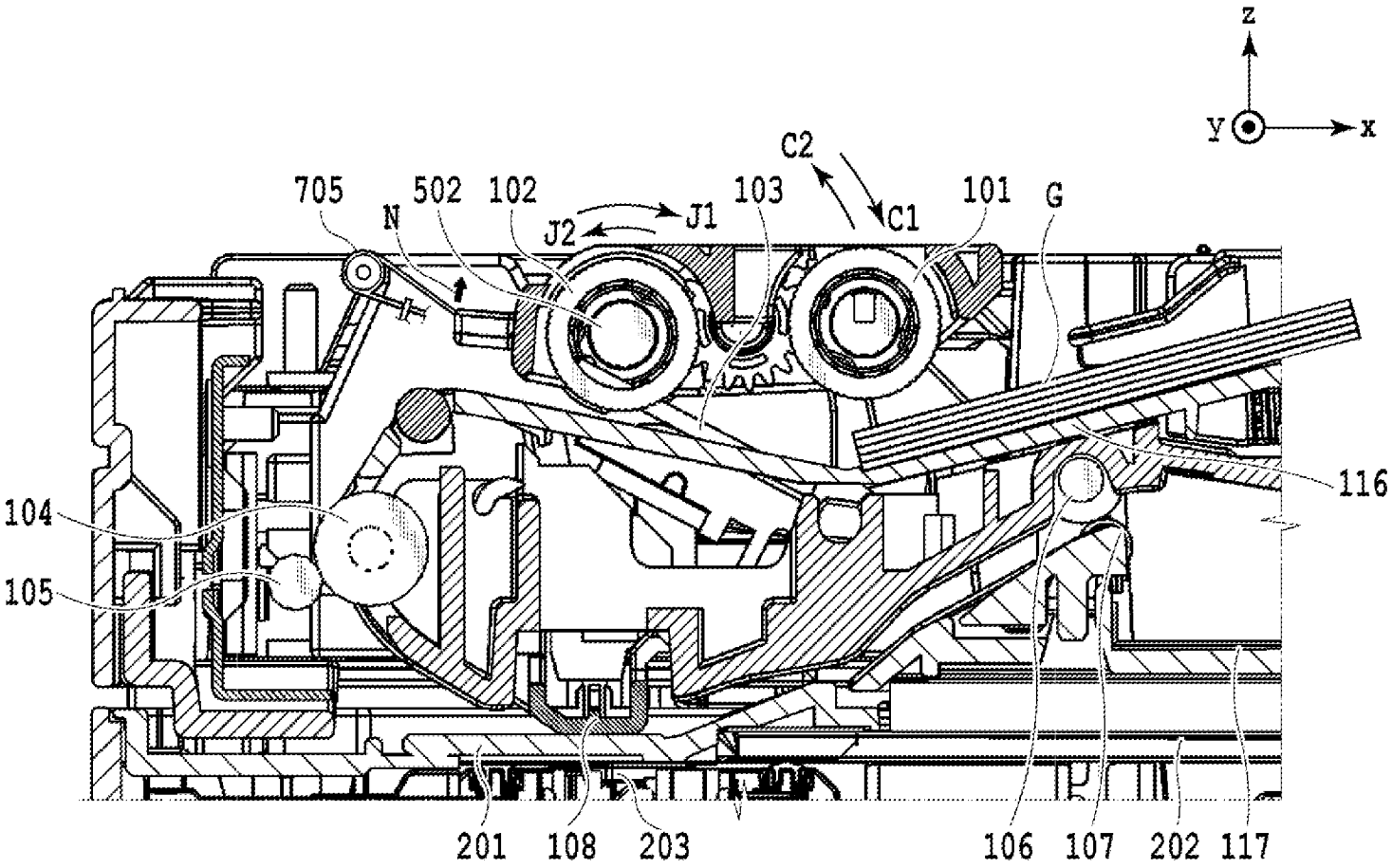
FIG. 4 is a cross-sectional view taken along Line IV-IV of FIG. 3.

FIG. 3 is a top view of the feeding mechanism 100. Further, FIG. 4 is a cross-sectional view taken along Line IV-IV of FIG. 3. The feeding mechanism 100 is referred to as an ADF, and the reading unit 203 positioned immediately below an ADF transparent member 201 is capable of reading the image of a document conveyed onto the ADF transparent member 201. As for the feeding mechanism 100, driving force is transmitted from the driver, which is not illustrated in the drawings, to a pickup roller 101, a separating roller 102, a conveyance roller 104, and a discharge roller 106. The pickup roller 101 and the separating roller 102 are arranged on the base 118. A document G loaded on a feeding tray 116, which is a sheet disposing unit, is preliminarily separated by the pickup roller 101 and fed to the separating roller 102. The separating roller 102 separates documents G one at a time between the separating roller 102 and the separating pad 103 and feeds the separated document G to the conveyance roller 104. The document G is nipped between the conveyance roller 104 and a conveyance idler roller 105, so as to be conveyed onto the ADF transparent member 201 by rotation of the conveyance roller 104. That document G is brought into close contact with the ADF transparent member 201 by a white background plate 108, which is urged by a spring, so that the image is read by the reading unit 203. Thereafter, the document G is nipped between the discharge roller 106 and a discharge idler roller 107, so as to be discharged to the discharge tray 117 by rotation of the discharge roller 106.

Figure 5A:
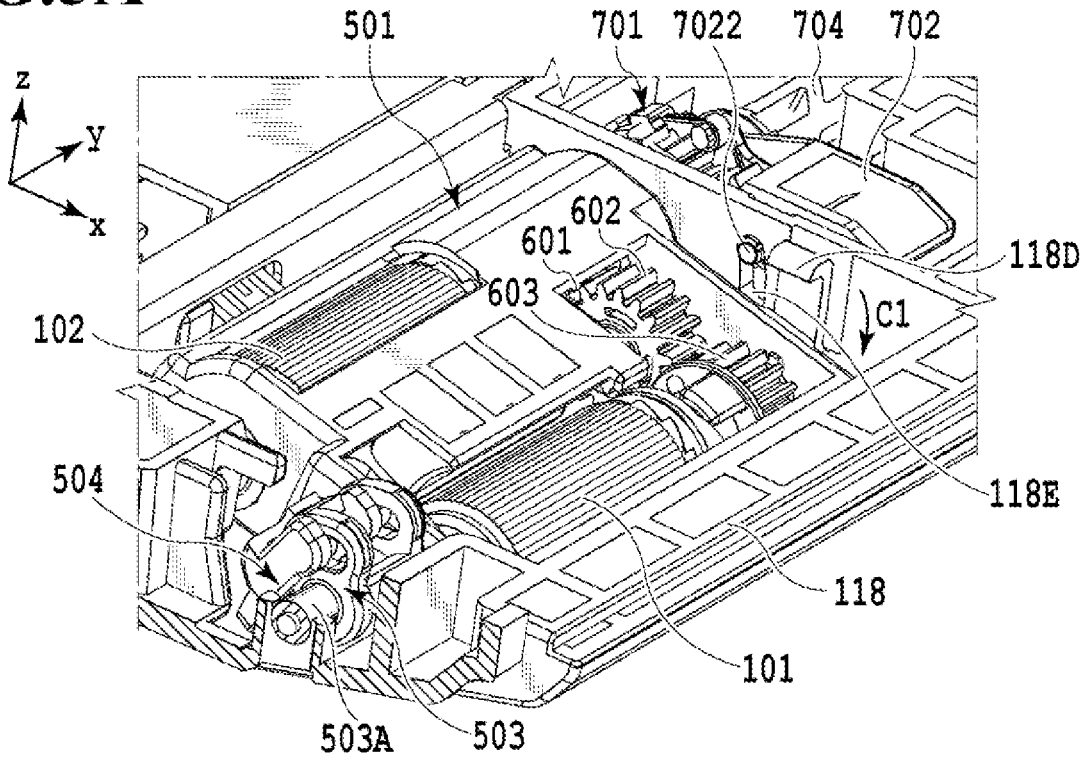
FIGS. 5A and 5B are perspective views of a separating unit of the feeding mechanism.
Figure 5B:
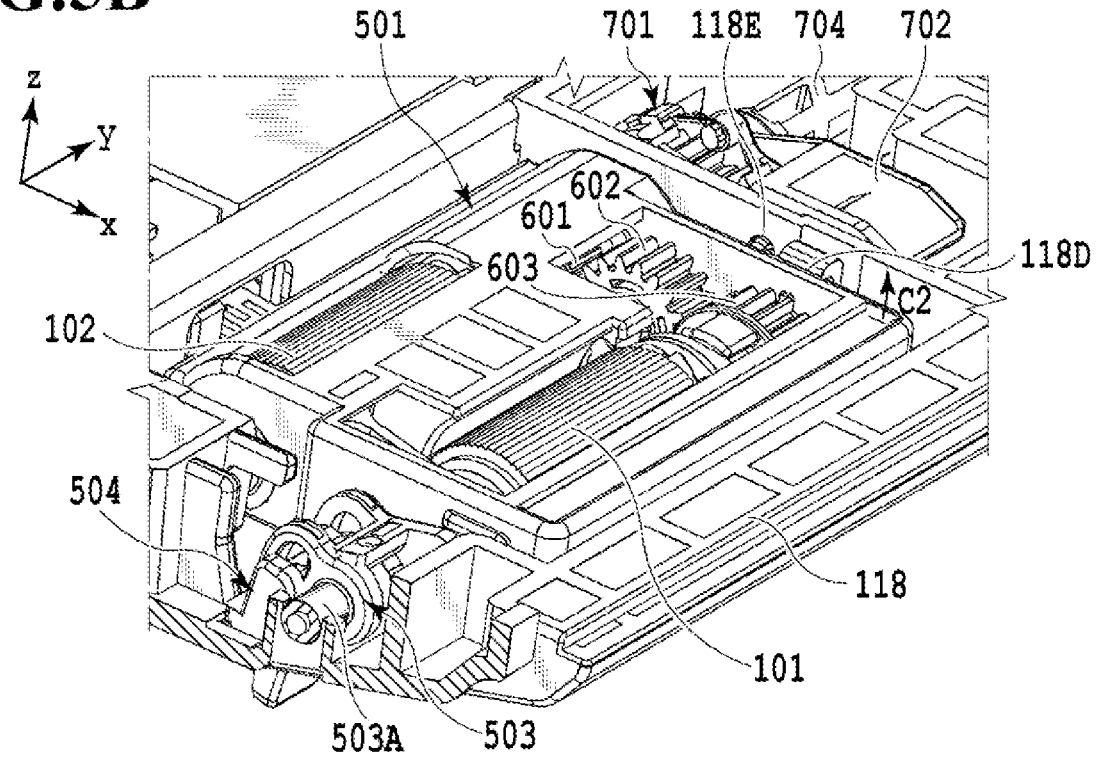

FIGS. 5A and 5B are perspective views of a separating unit for separating a document in the feeding mechanism 100, and FIG. 5A illustrates a state in which a document is being fed. The pickup roller 101, which is a feeding roller, is supported by the pickup arm (first swing member) 501 in a rotatable manner, and the pickup arm 501 is supported by the rotation shaft 502 (see FIG. 4) of the separating roller 102 in a swingable manner in the Arrow C1 direction and the Arrow C2 direction. The rotation shaft 502 of the separating roller 102 is supported by the base 118 in a rotatable manner and is connected to the shaft 704, which is positioned outside the base 118 and is driven by a driver that is not illustrated in the drawings. In a case where driving force in the reverse rotation direction, which is indicated by Arrow J2, is input from the shaft 704 to the rotation shaft 502, the pickup arm 501 pivotally moves in a direction away from the feeding tray 116 (the Arrow C2 direction of FIG. 4). As illustrated in FIG. 5B, the rotation position of the pickup arm 501 in the Arrow C2 direction is regulated as the pickup arm 501 abuts on the bumper 118D of the base 118. The regulated position is the position of the pickup arm 501 at the timing where a document is set, that is, the second position in which the pickup roller 101 is above and not in contact with the feeding tray 116. The rotary force of the rotation shaft 502 of the separating roller 102 is transmitted to the pickup roller 101 by a motive power transfer mechanism included in the pickup arm 501. In the case of the present example, the motive power transfer mechanism includes gears 601, 602 and 603.

Figure 6A:
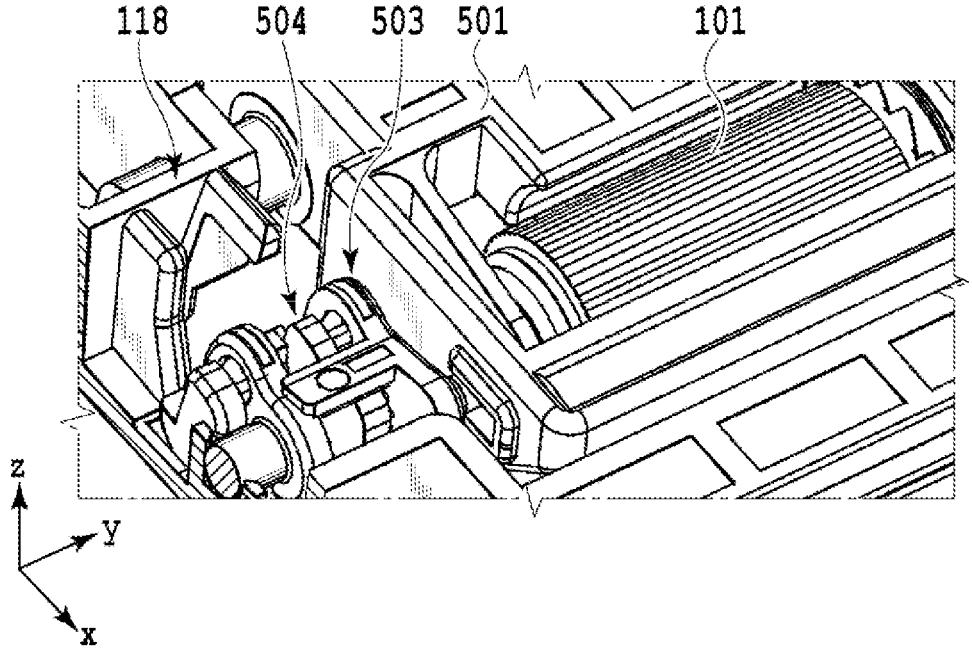
FIGS. 6A and 6B are perspective views of a document stopper in the feeding mechanism.
Figure 6B:
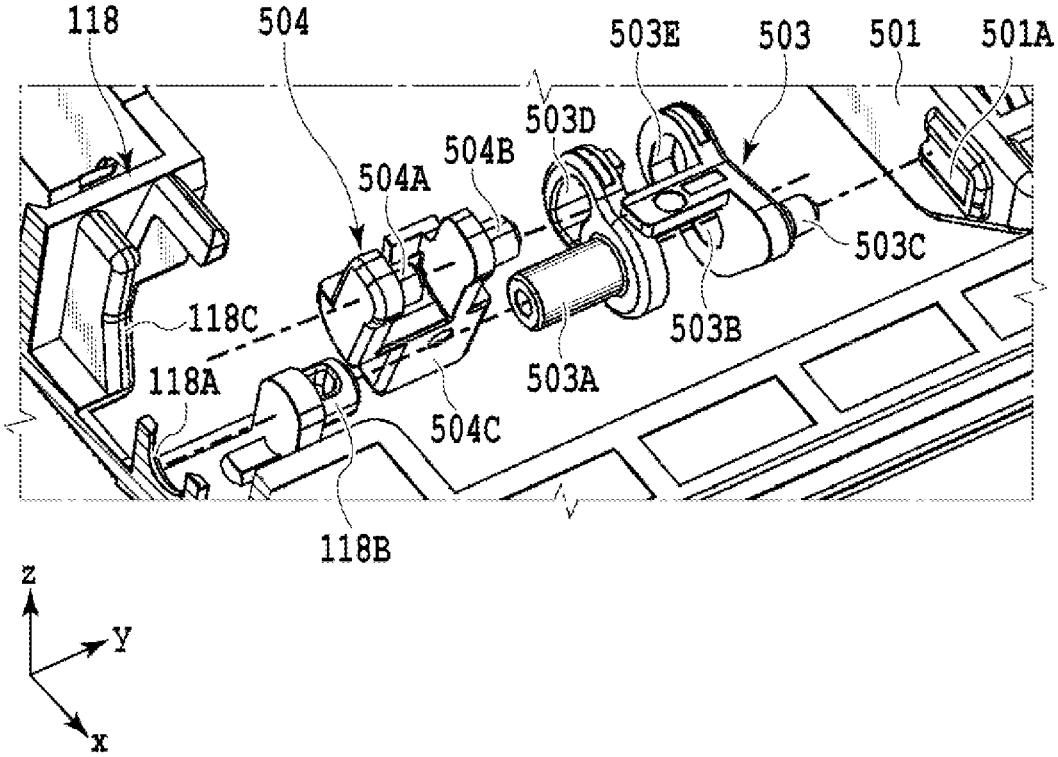

FIG. 6A is a perspective view of the parts in the vicinity of the document stopper (stopper) 504. FIG. 6B is an exploded perspective view of the document stopper 504. The document stopper 504 is a mechanism that aligns and sets a document at a desired position in order to stably feed documents. The rotation shaft 503A on one end side of the document stopper lever 503 is supported by the bearing 118A of the base 118 in a rotatable manner, and the bearing 503B on the other end side of the document stopper lever 503 is supported by the shaft 118B of the base 118 in a rotatable manner. The shaft 503C on the other end side of the document stopper lever 503 is supported by the guide groove 501A of the pickup arm 501 in a pivotable and slidable manner. The shafts 504A and 504B on one end side and the other end side of the document stopper lever 503 are supported in a pivotable and slidable manner by the bearings 503D and 503E, which are in shapes of circular arcs, on one end side and the other end side of the document stopper lever 503, respectively.

Figure 7:
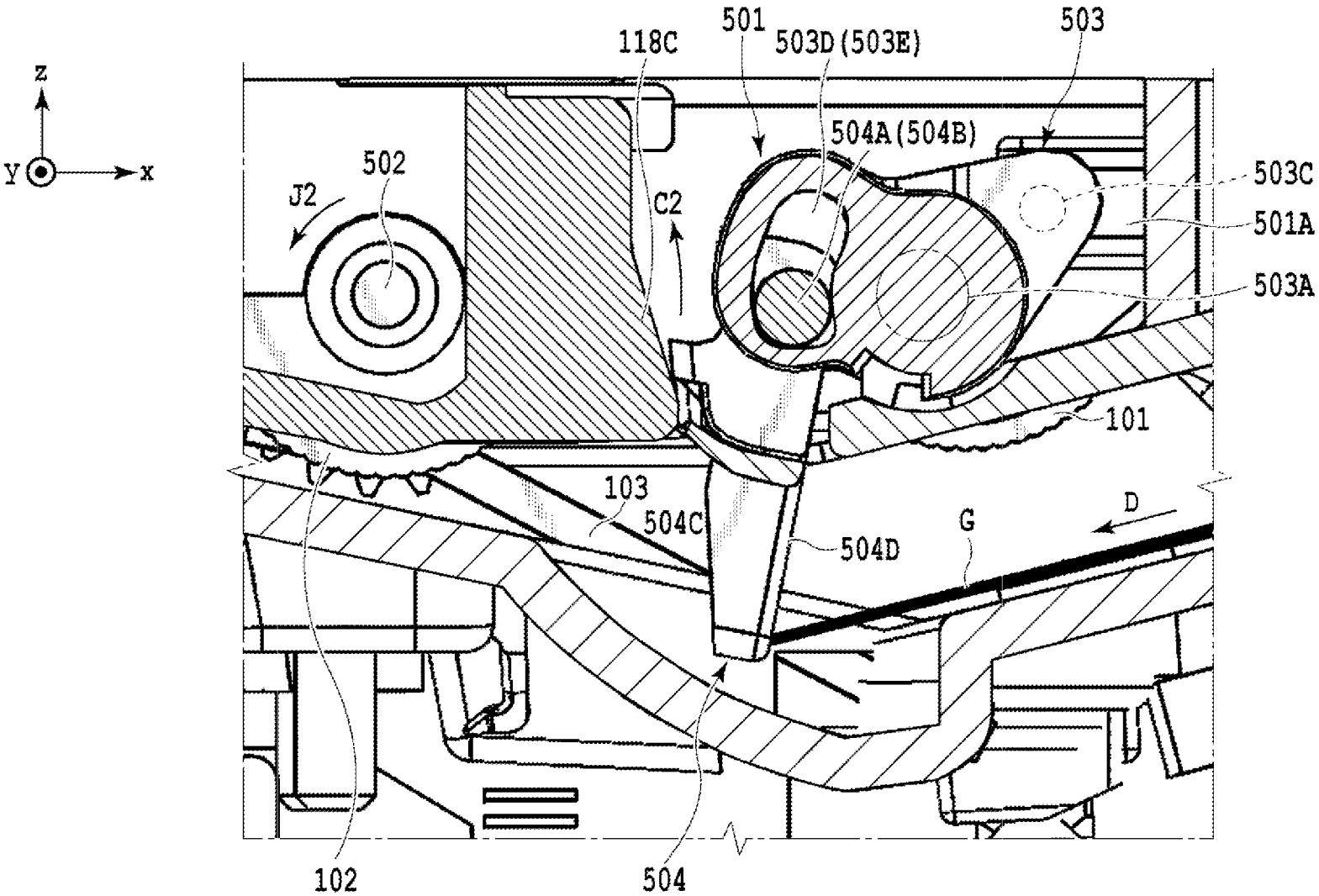
FIG. 7 is a cross-sectional view taken along Line VII-VII of FIG. 3.

FIG. 7 is a cross-sectional view taken along Line VII-VII of FIG. 3. The shafts 504A and 504B of the document stopper 504 are engaged with the bearings 503D and 503E of the document stopper lever 503, so that the document stopper 504 is supported by the document stopper lever 503 in a movable manner. The document stopper 504 is provided with the stopper portion 504C that abuts on the stopper receiving portion 118C of the base 118. On the upstream side of the conveying direction (the Arrow D direction) of the document G, the document stopping surface 504D is formed on the document stopper 504, and the leading edge of the document G abuts on the document stopping surface 504D, so that the document G is set at the desired position. In this way, as the document stopper 504 moves to the regulating position for regulating the position of the leading edge of the document G, it is possible to align and set the document G.

Figure 8:
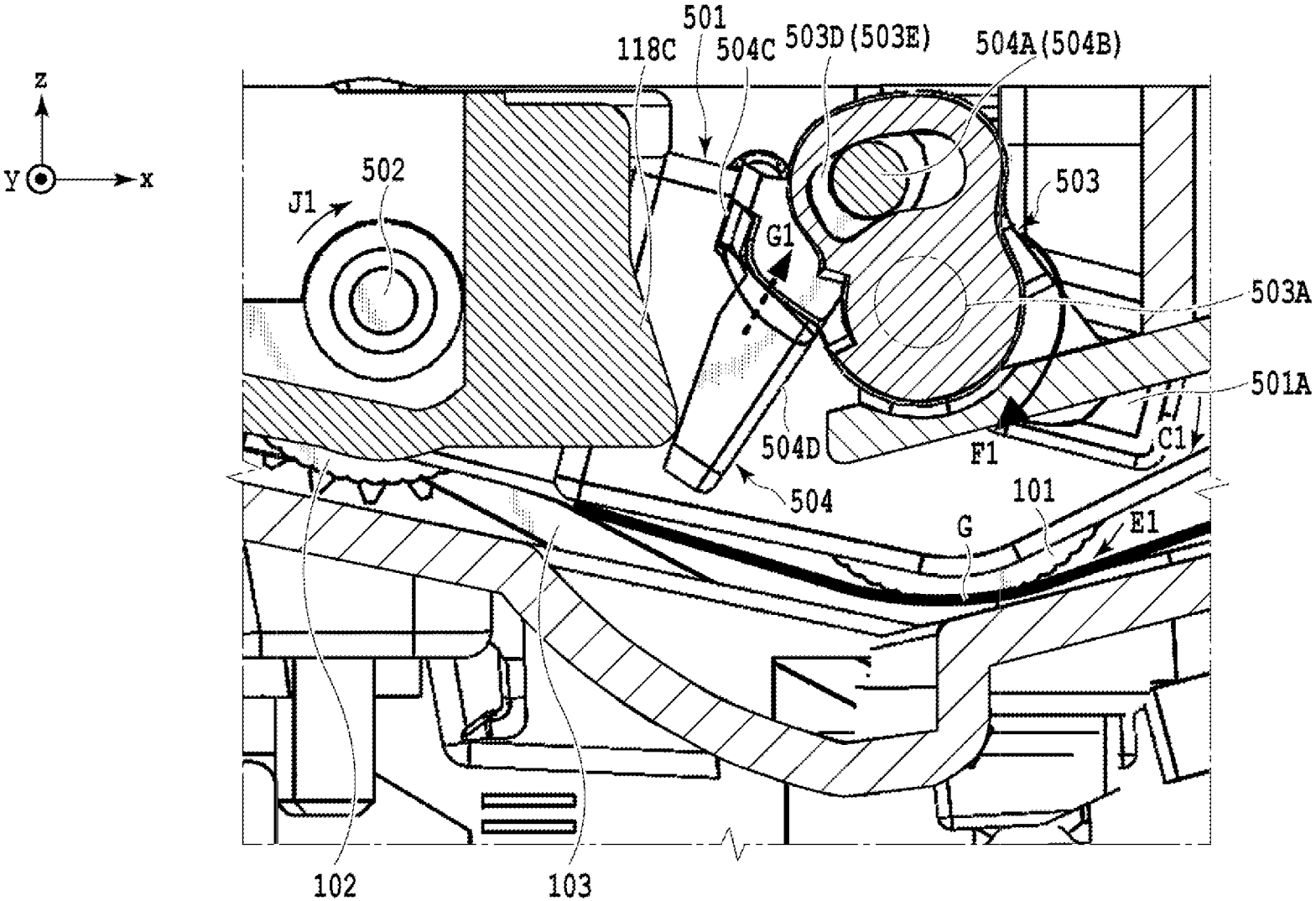
FIG. 8 is a cross-sectional view taken along Line VII-VII of FIG. 3, in which the document stopper is in a different operating status.
Figure 9A:
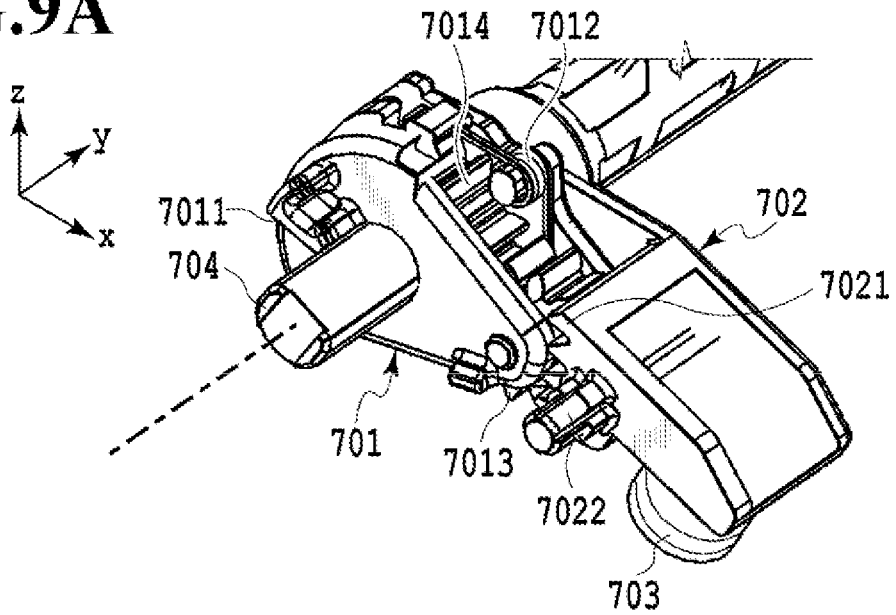
FIGS. 9A and 9B are perspective views of a pickup mechanism in the feeding mechanism.
Figure 9B:
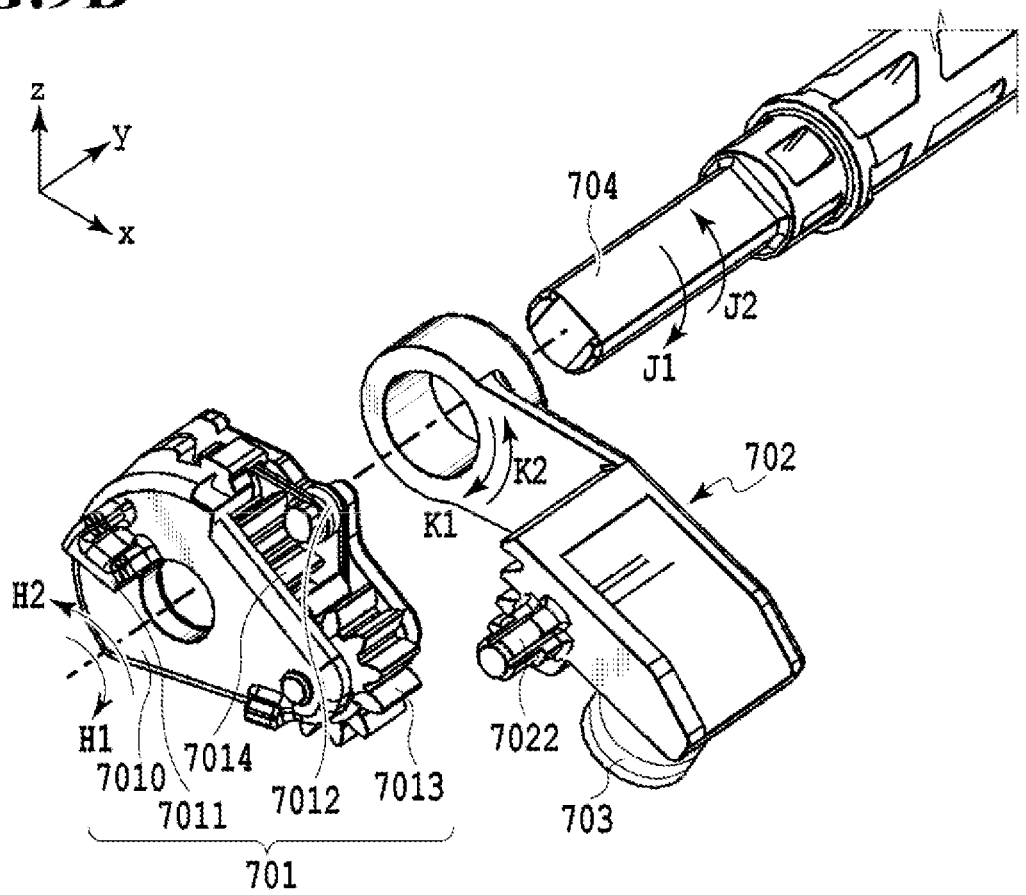
Figure 10A:
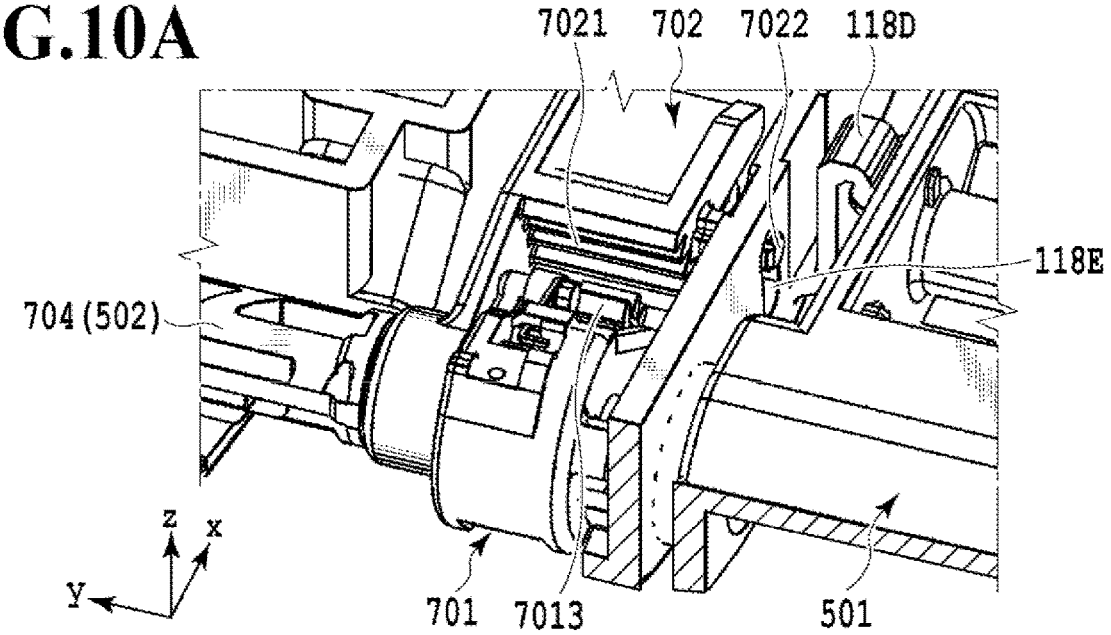
FIGS. 10A and 10B are perspective views of the parts in the vicinity of the pickup mechanism of FIGS. 9A and 9B.
Figure 10B:
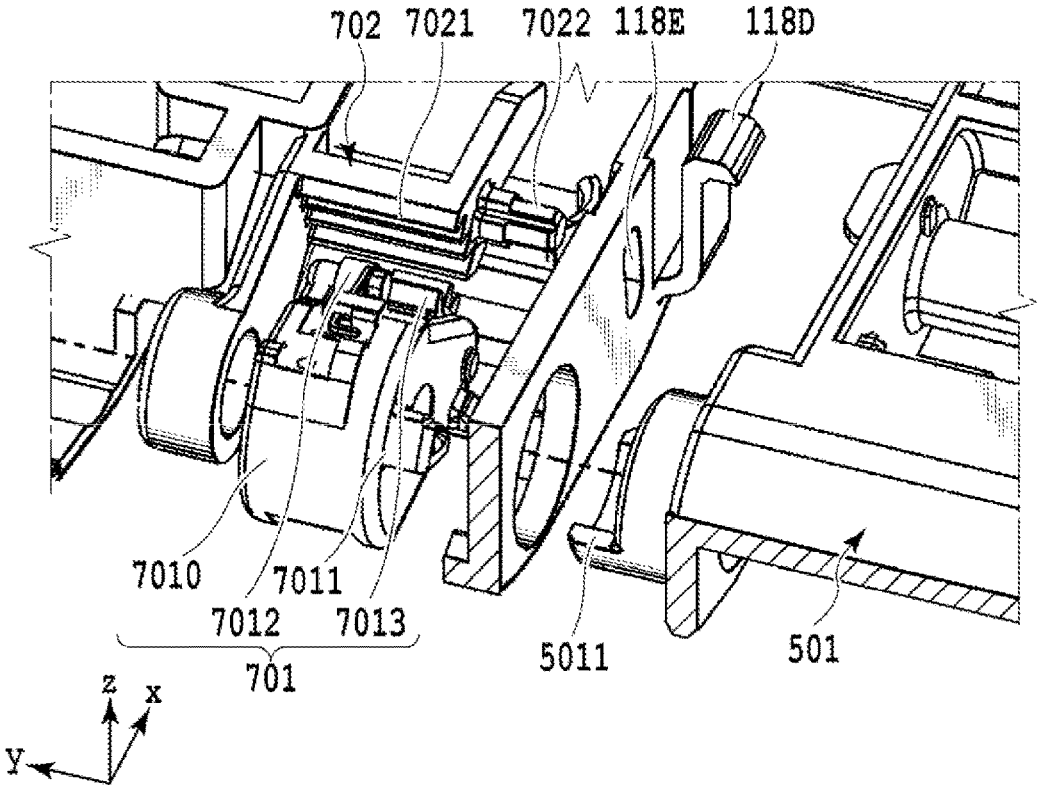

FIG. 8 is the same cross-sectional view as FIG. 7, and FIG. 8 illustrates a state in which the document G is being fed. First, driving force in a forward direction is input to the shaft 704, so that the rotation shaft 502 of the separating roller 102 rotates in the Arrow J1 direction. As the rotary force is applied to the pickup arm 501, the pickup arm 501 rotates about the rotation shaft 502 in the Arrow C1 direction, so that the pickup arm 501 approaches the document G. Here, as will be described later, the pickup roller 101 supported by the pickup arm 501 is brought into a pressure contact with the document G while rotating in the Arrow E1 direction, so that the document G, which is the topmost sheet, is fed. The swing position of the pickup arm 501 at the timing where the pickup roller 101 is in contact with the document G is the first position. The shaft 503C of the document stopper lever 503 is supported by the guide groove 501A of the pickup arm 501 in a slidable manner. Therefore, the document stopper lever 503 pivotally moves in the Arrow F1 direction about the rotation shaft 503A as the pickup arm 501 pivotally moves in the Arrow C1 direction. The document stopper 504 supported by the document stopper lever 503 moves in the Arrow G1 direction, which is a direction away from the document G, in synchronization with the pivotal movement of the document stopper lever 503 in the Arrow F1 direction. Here, the stopper portion 504C of the document stopper 504 moves away from the stopper receiving portion 118C of the base 118. As a result, the document stopper 504 moves to the retracted position in which the position of the leading edge of the document G is not regulated.

Thereafter, the leading edge of the document G fed by the rotation of the pickup roller 101 in the Arrow E1 direction makes contact with the document stopping surface 504D of the document stopper 504. Since the shafts 504A and 504B of the document stopper 504 are supported by the bearings 503D and 503E of the document stopper lever 503 in a rotatable and slidable manner, the document stopper 504 moves along the bearings 503D and 503E, which are in shapes of circular arcs, as the document stopper 504 receives the contact force from the leading edge of the document G. As a result, the document stopper 504 retracts to a position in which the document stopper 504 is far enough from the document G so as not to be a resistance that has an effect on feeding of the document G. The document G fed by the pickup roller 101 is conveyed toward the conveyance roller 104 after only the one topmost sheet is separated by the separating roller 102 and the separating pad 103.

FIGS. 9A, 9B, 10A, and 10B are explanatory diagrams of the pickup mechanism. The pendulum 701, which functions as the third swing member, includes a support member 7010, a spring member 7012, an input gear 7014, and an engagement gear (planetary gear) 7013. The input gear 7014 is connected to the shaft 704, which is coaxially connected to the rotation shaft 502 of the separating roller 102, and the engagement gear 7013 meshes with the input gear 7014. One end of the spring member 7012 is supported by the support member 7010 and the other end is in contact with the axial portion, which is the rotational center of the engagement gear 7013, so that, as the urging force is applied to the axial portion in a direction intersecting the axial direction, a rotational friction resistance is applied to the engagement gear 7013. Due to the rotational friction resistance, the pendulum 701 pivotally moves about the shaft 704 in the Arrow H1 direction and the Arrow H2 direction. The support member 7010 is provided with the abutment portion 7011 that abuts on the pickup arm 501. As will be described later, after the pendulum 701 rotates in the Arrow H2 direction so that the abutment portion 7011 abuts on the abutment portion 5011 of the pickup arm 501, both the pendulum 701 and the pickup arm 501 pivotally move in the Arrow H2 direction together.

Figure 11A:
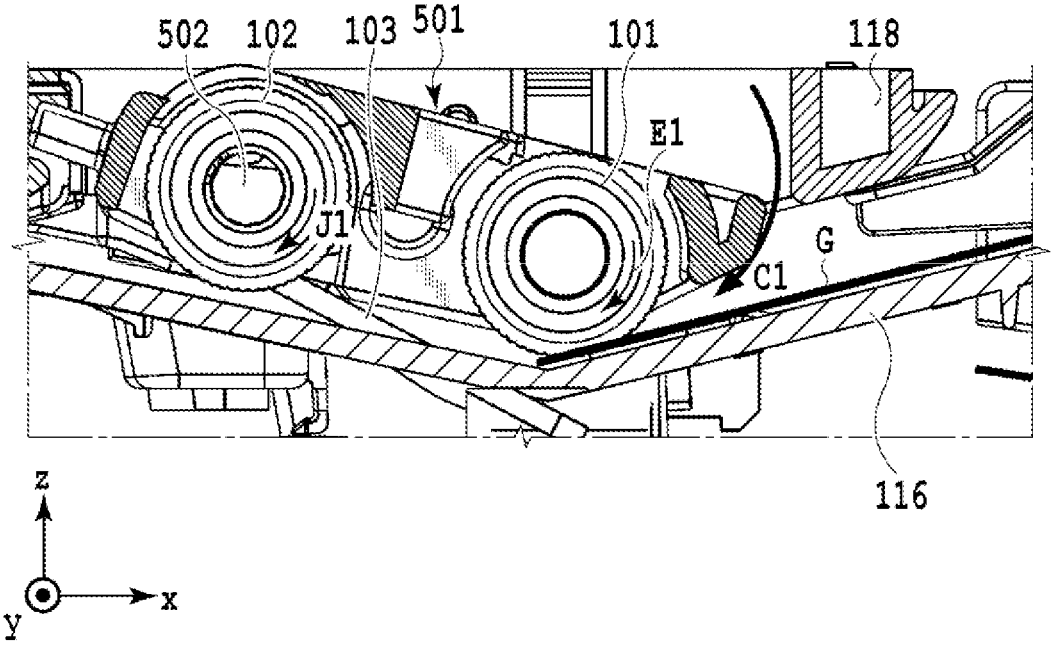
FIGS. 11A and 11B are cross-sectional views of the feeding mechanism.
Figure 11B:
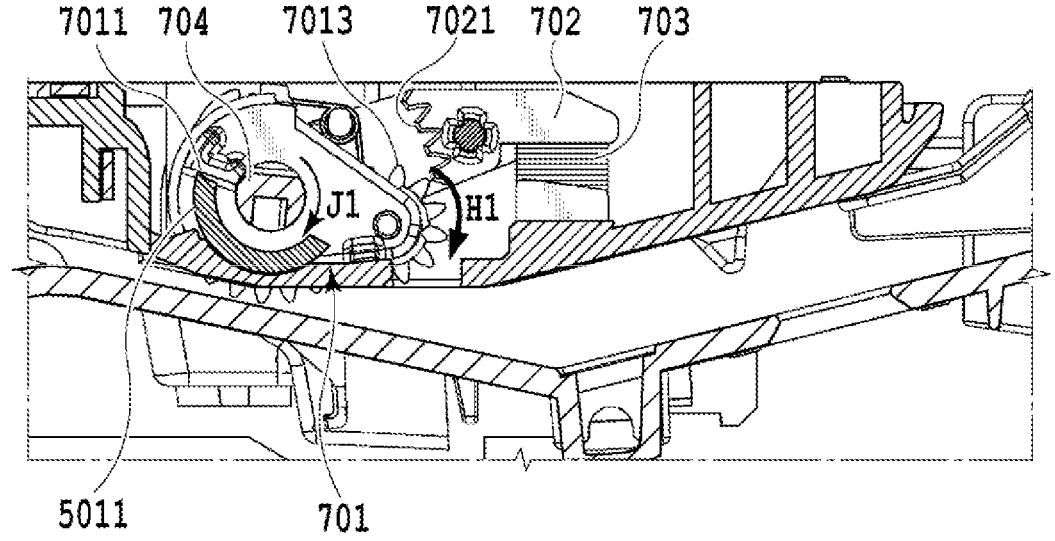

The arm member 702, which is a second swing member, is engaged with the shaft 704 in a swingable manner in the Arrow K1 direction and the Arrow K2 direction, and the arm member 702 is provided with the engagement portion 7021, which is in a shape of an internal gear that engages with the engagement gear 7013 of the pendulum 701. Since the engagement portion 7021 has a shape of an internal gear, the engagement portion 7021 and the engagement gear 7013 can be smoothly engaged and the engagement thereof can be smoothly released, so that it is possible to prevent the engagement portion 7021 and the engagement gear 7013 from being worn due to repeatedly-performed engagement and release of the engagement. The arm member 702 includes a compression spring (elastic member) 703 (see FIG. 11B), which is positioned between the arm member 702 and a predetermined position of the base 118, so as to urge the arm member 702 in the Arrow K2 direction. Since the above-described compression spring 703 is included, it is possible to fix the stand-by position of the arm member 702 as illustrated in FIG. 11B by use of the elastic restoring force generated by deformation of the compression spring 703, and it is also possible to stabilize the engagement position of the pendulum 701 and the arm member 702. The configuration for urging the arm member 702 in the Arrow K2 direction is not limited to such a configuration including the compression spring 703, and there may be a configuration including various forms of springs and elastic members. The movable range of the arm member 702 is regulated by the axial portion 7022 of the arm member 702 and the cutout part 118E of the base 118 (see FIG. 5A).

An explanation is given of the pickup operation of the feeding mechanism 100 with reference to FIGS. 11A through 14B. Each of FIG. 11A, FIG. 12A, FIG. 13A, and FIG. 14A is the same cross-sectional view as FIG. 4, and each of FIG. 11A, FIG. 12A, FIG. 13A, and FIG. 14A illustrates a different operating status. Further, each of FIG.

Figure 12A:
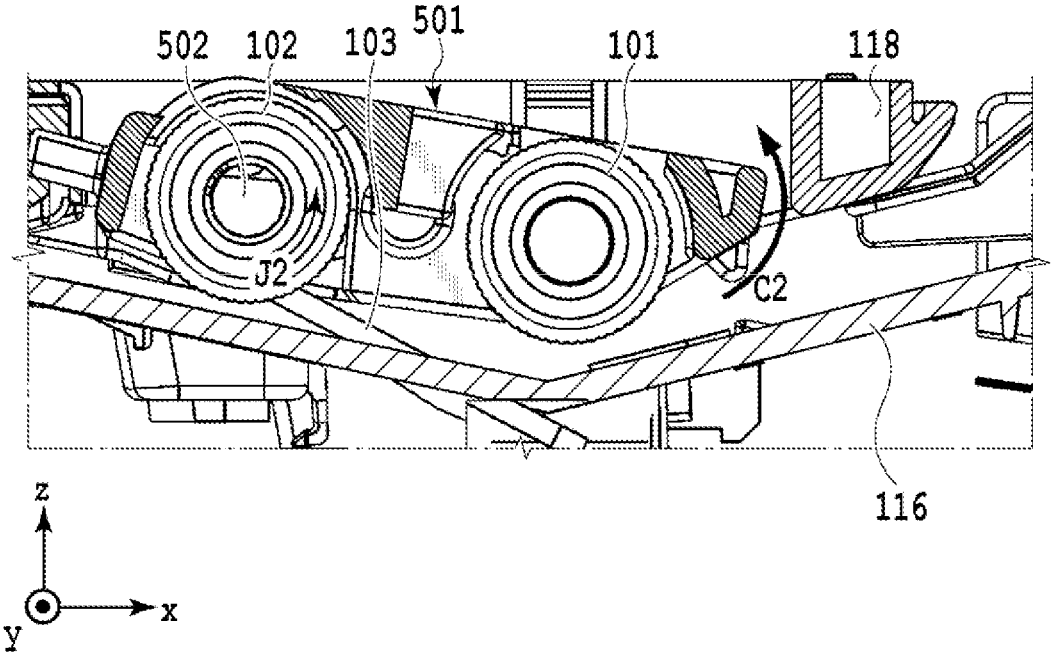
FIGS. 12A and 12B are cross-sectional views of the feeding mechanism in a different operating status.
Figure 12B:
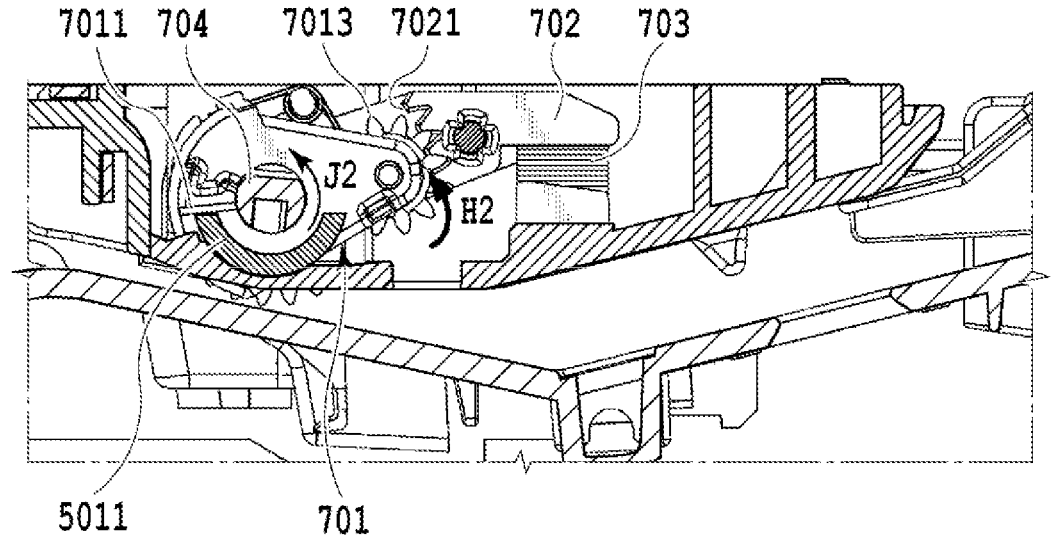
Figure 13A:
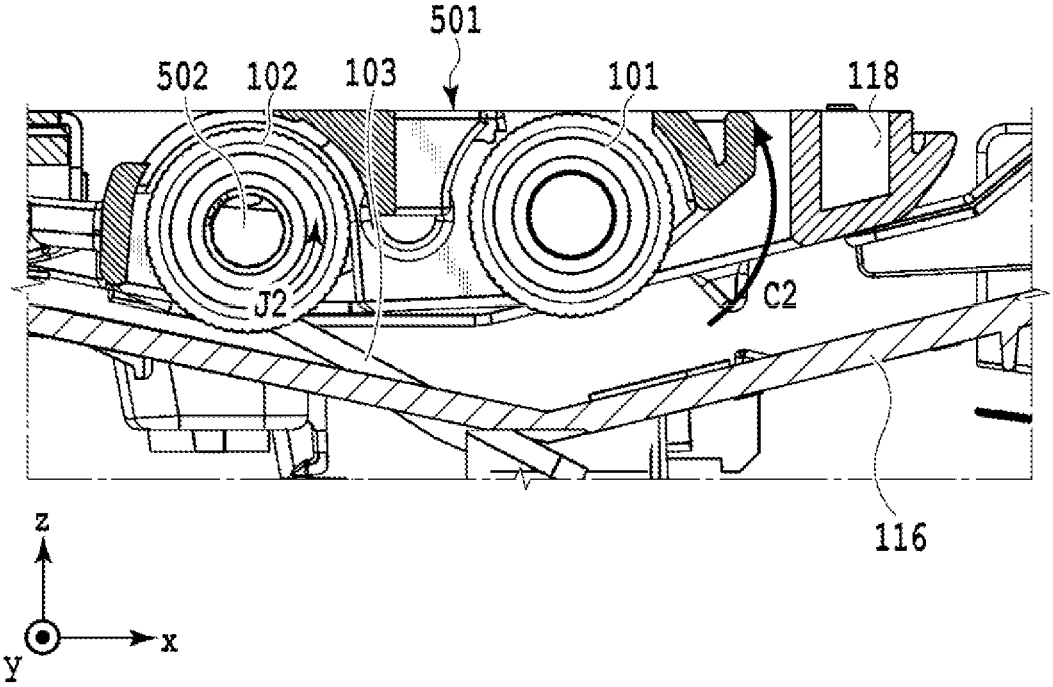
FIGS. 13A and 13B are cross-sectional views of the feeding mechanism in a further different operating status.
Figure 13B:
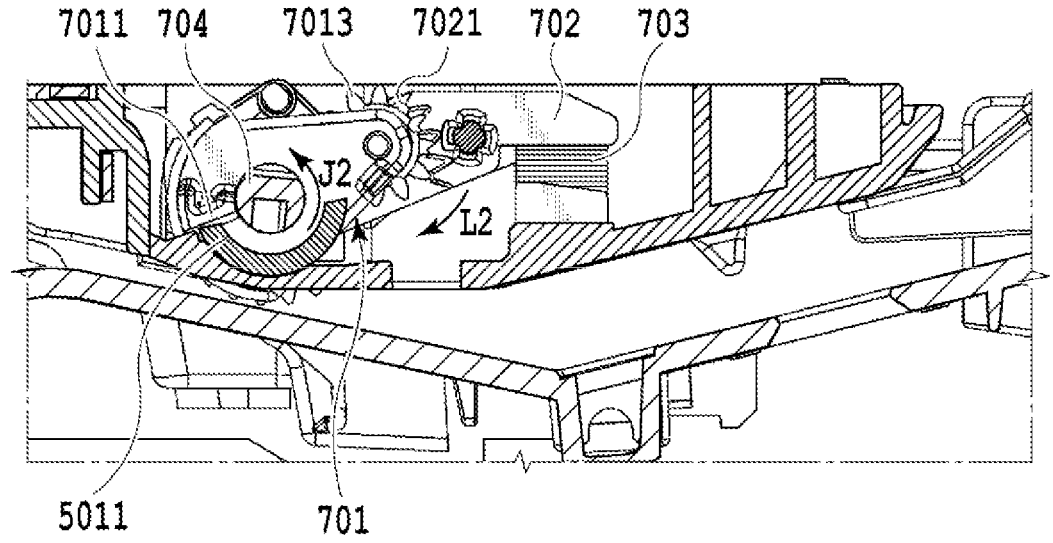
Figure 14A:
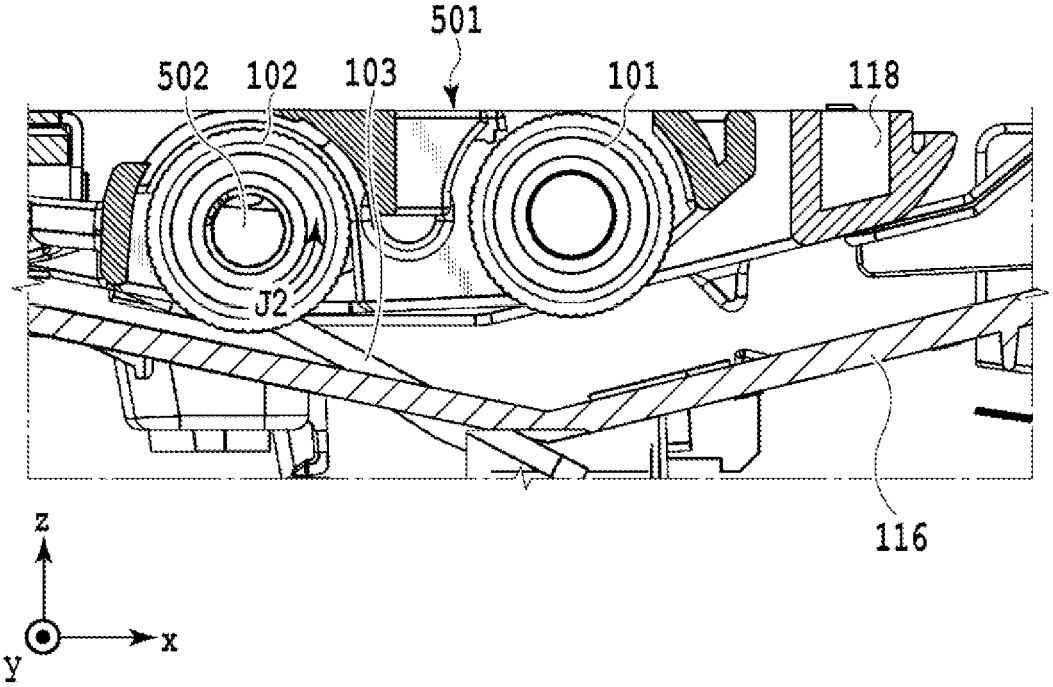
FIGS. 14A and 14B are cross-sectional views of the feeding mechanism in a further different operating status.
Figure 14B:
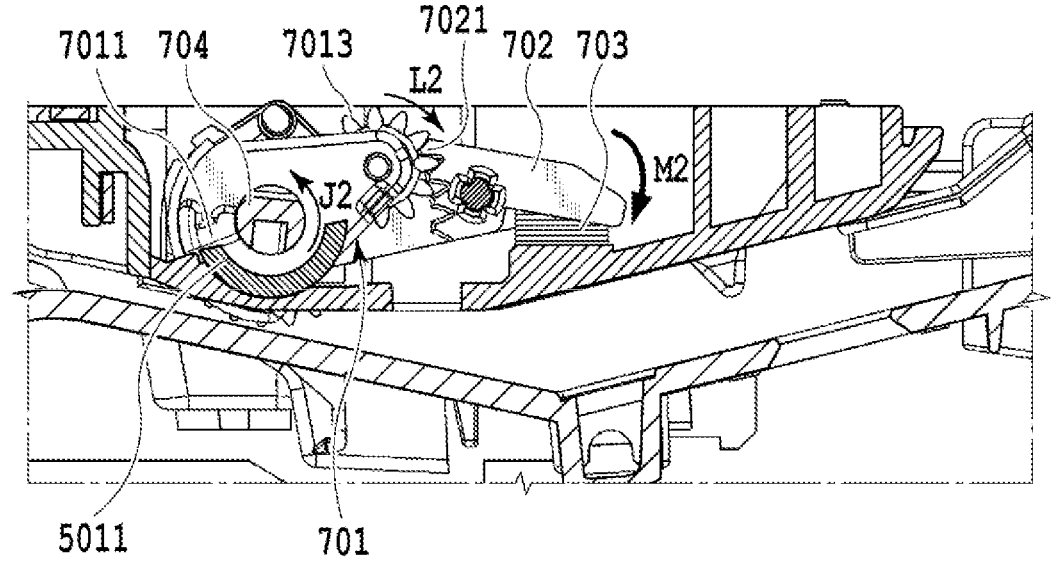

11B, FIG. 12B, FIG. 13B, and FIG. 14B is a cross-sectional view taken along Line XI-XI of FIG. 3, and each of FIG. 11B, FIG. 12B, FIG. 13B, and FIG. 14B illustrates a different operating status.

By inputting driving force in the Arrow J1 direction from the shaft 704 that is coaxial with the rotation shaft 502 of the separating roller 102, the pendulum 701 to which the rotational friction resistance is applied pivotally moves in the Arrow H1 direction as illustrated in FIG. 11B. As a result, the engagement gear 7013 releases the engagement with the engagement portion 7021 in a shape of an internal gear of the arm member 702. Thereafter, as illustrated in FIG. 11A, the pickup arm 501 pivotally moves about the rotation shaft 502 in the Arrow C1 direction toward the document G due to its own weight including the pickup roller 101. The pickup roller 101 makes a pressure contact with the document G while rotating in the Arrow E1 direction as the motive power transfer mechanism (including gears 601, 602, and 603) transmits the rotary force of the rotation shaft 502, so that the topmost document G is fed. Here, by applying the urging force in the Arrow C1 direction to the pickup arm 501 by use of such a torsion coil spring (urging member) 705 as illustrated in FIG. 4 so as to press the pickup roller 101 against the document G, an appropriate feeding pressure for feeding a document is applied.

Specifically, one end of the torsion coil spring 705 is fixed in an engaged state at a predetermined position of the main body of the apparatus, and the other end thereof is fixed in an engaged state at a left end portion of the pickup arm 501 as illustrated in FIG. 4, so that the left end portion of the pickup arm 501 is urged in the Arrow N direction in FIG. 4. In this way, by applying the urging force in the Arrow C1 direction for pressing the pickup roller 101 against the document G, it is possible to suppress the occurrence of a document feeding failure due to insufficient feeding pressure. The configuration for urging the pickup roller 101 in the Arrow C1 direction is not limited to such a configuration including the torsion coil spring 705, and there may be a configuration including various forms of springs, elastic members, etc. The arm member 702, which is constantly urged upward by the compression spring 703, is not engaged with the pendulum 701 as illustrated in FIG. 11B during feeding of a document.

Next, an explanation is given of an initializing operation, which is performed after completion of feeding a document to make the feeding tray 116 into a state where a document can be set. In the initializing operation, the driving force for reverse rotation in the Arrow J2 direction is input to the shaft 704, so that the pendulum 701 pivotally moves in the Arrow H2 direction as illustrated in FIG. 12B, and the engagement gear 7013 is engaged with the engagement portion 7021 of the arm member 702. Thereafter, the abutment portion 7011 of the pendulum 701 abuts on the abutment portion 5011 of the pickup arm 501, so that the pickup arm 501 pivotally moves in the Arrow C2 direction together with the pendulum 701 as illustrated in FIG. 12A. In this way, the arm member 702 is urged upward by the compression spring 703 in a state where the arm member 702, the pendulum 701, and the pickup arm 501 are associated with each other. On the other hand, the pickup arm 501 is urged downward by the torsion coil spring 705 toward the documents, that is, in the direction of pushing back the arm member 702 downward. The moment that the compression spring 703 rotates the arm member 702 upward is set to be larger than the moment that the torsion coil spring 705 rotates the arm member 702 downward. As a result, it is possible to avoid a situation in which the position of the arm member 702 is lowered in a case where the pickup arm 501 is pivotally moved in the Arrow C2 direction. Furthermore, it is possible to avoid a situation in which the pickup arm 501 cannot be returned to the position (position at the timing where a document is set) where the pickup arm 501 abuts on the bumper 118D of the base 118.

Furthermore, in a case where the reverse rotation of the shaft 704 in the Arrow J2 direction is continued, the pickup arm 501 pivotally moves in the Arrow C2 direction together with the pendulum 701 and abuts on the bumper 118D of the base 118, so that the pivotal movement is stopped. As a result, the pickup arm 501 returns to the "position at the timing where a document is set" as illustrated in FIG. 13A. In the meantime, the pivotal movement of the pendulum 701 is also stopped as illustrated in FIG. 13B. Here, because of the above-described relationship between the moments, the arm member 702 remains urged upward. Furthermore, in a case where the reverse rotation of the shaft 704 in the Arrow J2 direction is continued as illustrated in FIG. 14A, the engagement gear 7013 of the pendulum 701 pivotally moves in the Arrow L2 direction via the input gear 7014 while the pivotal movement of the pickup arm 501 is stopped, as illustrated in FIG. 14B. As a result, the arm member 702 pivotally moves about the shaft 704 in the Arrow M2 direction, so as to compress the compression spring 703.

In this way, the compression spring 703 is compressed by reverse rotation of the shaft 704 in the Arrow J2 direction after the pickup arm 501 abuts on the bumper 118D of the base 118, that is, after the pickup arm 501 swings to the second position. The elastic restoring force of the compression spring 703 pushes the pickup arm 501 toward the bumper 118D and functions as regulating force for regulating the pickup arm 501 to the second position.

Thereafter, by stopping the driving of the shaft 704, the arm member 702 stops the pivotal movement, and the postures of the pendulum 701 and the arm member 702 are maintained because of the rotational friction resistance applied to the pendulum 701 and the rotational friction resistance applied to the engagement portion between the pendulum 701 and the arm member 702. Because of such a configuration, within the movable region of the arm member 702, variations in the amount of pivotal movement of the pickup arm 501 caused by variations in component tolerances and driving amounts can be absorbed.

OTHER EMBODIMENTS

The sheet feeding apparatus of the present invention is capable of feeding various sheets, which are not limited to such a document whose image is read by an image reading apparatus as in the above-described embodiment. For example, it is possible to feed a sheet on which an image is printed by a printing apparatus, a sheet on which a physical process or a chemical process is performed by various processing apparatus, etc. As a specific example, see the schematic view in FIG. 15, in which the feeding mechanism 100 is associated with the printing apparatus 3 so as to feed sheets to the printing apparatus. Furthermore, there may be a form in which the sheet feeding apparatus of the present invention is configured with an apparatus other than such an image reading apparatus, a printing apparatus, and various processing apparatus, and there may be also a form in which the sheet feeding apparatus is incorporated in such apparatus as a part of the configurations thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-147518, filed Aug. 9, 2019, which is hereby incorporated by reference herein in its entirety.

What is claimed is:

1. A sheet feeding apparatus comprising:

a sheet disposing unit on which a sheet is disposed;

a feeding member configured to feed the sheet disposed on the sheet disposing unit;

a first swing member configured to support the feeding member and be swingable between a first position, at which the feeding member is in contact with the sheet disposed on the sheet disposing unit, and a second position, at which the feeding member is more distanced from the sheet disposing unit, compared to the first position, wherein the first swing member abuts on a bumper at the second position;

a rotation member configured to rotate in a first direction for swinging the first swing member from the second position to the first position and rotate in a second direction that is opposite to the first direction; and a second swing member configured to swing in accordance with rotation of the rotation member in the second direction and push the first swing member toward the bumper in accordance with rotation of the rotation member, after the first swing member abuts on the bumper.

2. The sheet feeding apparatus according to claim 1, wherein the second swing member deforms an elastic member by rotation of the rotation member in the second direction after the first swing member abuts on the bumper, so that the first swing member is pushed toward the bumper in accordance with a restoring force of the elastic member.

3. The sheet feeding apparatus according to claim 2, further comprising:

an urging member configured to urge the first swing member in a direction from the second position toward the first position, wherein a moment about the rotation member caused by the elastic member urging the first swing member in a direction from the first position toward the second position is larger than a moment about the rotation member caused by the urging member.

4. The sheet feeding apparatus according to claim 1, wherein the feeding member rotates in accordance with rotation of the rotation member.

5. The sheet feeding apparatus according to claim 1, further comprising:

a third swing member configured to swing the second swing member in the first direction by rotary force of the rotation member in the second direction after the first swing member swings to the second position.

6. A sheet feeding apparatus comprising:

a sheet disposing unit on which a sheet is disposed;

a feeding member configured to feed the sheet disposed on the sheet disposing unit;

a first swing member configured to support the feeding member and be swingable between a first position, at which the feeding member is in contact with the sheet disposed on the sheet disposing unit, and a second position, at which the feeding member is more distanced from the sheet disposing unit, compared to the first position;

a rotation member configured to rotate in a first direction for swinging the first swing member from the second position to the first position and rotate in a second direction that is opposite to the first direction;

a second swing member configured to swing in the first direction in accordance with rotation of the rotation member in the second direction after the first swing member swings to the second position; and a third swing member configured to swing the second swing member in the first direction by rotary force of the rotation member in the second direction after the first swing member swings to the second position, wherein the second swing member includes an internal gear, and wherein the third swing member includes a planetary gear configured to mesh with the internal gear in accordance with rotation of the rotation member in the second direction after the first swing member swings to the second position.

7. A sheet feeding apparatus comprising:

a sheet disposing unit on which a sheet is disposed;

a feeding member configured to feed the sheet disposed on the sheet disposing unit;

a first swing member configured to support the feeding member and be swingable between a first position, at which the feeding member is in contact with the sheet disposed on the sheet disposing unit, and a second position, at which the feeding member is more distanced from the sheet disposing unit, compared to the first position, wherein the first swing member abuts on a bumper at the second position;

a rotation member configured to rotate in a first direction for swinging the first swing member from the second position to the first position and rotate in a second direction that is opposite to the first direction;

a second swing member configured to swing in accordance with rotation of the rotation member in the second direction and push the first swing member toward the bumper in accordance with rotation of the rotation member, after the first swing member abuts on the bumper; and a stopper configured to move according to swinging of the first swing member, wherein, in a case in which the first swing member swings to the second position, the stopper moves to a regulating position at which a position of a leading edge of the sheet disposed on the sheet disposing unit is regulated, and, in a case in which the first swing member swings to the first position, the stopper moves to a retracted position at which a position of a leading edge of the sheet disposed on the sheet disposing unit is not regulated.

8. A printing apparatus comprising:

a sheet disposing unit on which a sheet is disposed;

a feeding member configured to feed the sheet disposed on the sheet disposing unit;

a printing unit configured to print an image on the sheet fed by feeding member;

a first swing member configured to support the feeding member and be swingable between a first position, at which the feeding member is in contact with the sheet disposed on the sheet disposing unit, and a second position, at which the feeding member is more distanced from the sheet disposing unit, compared to the first position, wherein the first swing member abuts on a bumper at the second position;

a rotation member configured to rotate in a first direction for swinging the first swing member from the second position to the first position and rotate in a second direction that is opposite to the first direction; and a second swing member configured to swing in accordance with rotation of the rotation member in the second direction and to push the first swing member toward the bumper in accordance with rotation of the rotation member, after the first swing member abuts on the bumper.

9. The printing apparatus according to claim 8, wherein the second swing member deforms an elastic member by rotation of the rotation member in the second direction after the first swing member abuts on the bumper, so that the first swing member is pushed toward the bumper in accordance with a restoring force of the elastic member.

10. The printing apparatus according to claim 9, further comprising:

an urging member configured to urge the first swing member in a direction from the second position toward the first position, wherein a moment about the rotation member caused by the elastic member urging the first swing member in a direction from the first position toward the second position is larger than a moment about the rotation member caused by the urging member.

11. The printing apparatus according to claim 8, further comprising:

a third swing member configured to swing the second swing member in the first direction by rotary force of the rotation member in the second direction after the first swing member swings to the second position.

12. The printing apparatus according to claim 8, further comprising:

a stopper configured to move according to swinging of the first swing member, wherein, in a case in which the first swing member swings to the second position, the stopper moves to a regulating position at which a position of a leading edge of the sheet disposed on the sheet disposing unit is regulated, and, in a case in which the first swing member swings to the first position, the stopper moves to a retracted position at which a position of a leading edge of the sheet disposed on the sheet disposing unit is not regulated.

13. The printing apparatus according to claim 8, wherein the feeding member rotates in accordance with rotation of the rotation member.

* * * * *